US008807908B2

(12) United States Patent
Lessard

(10) Patent No.: US 8,807,908 B2
(45) Date of Patent: Aug. 19, 2014

(54) MECHANICAL PRESSURE CONTROL FOR A LOAD-HANDLING DEVICE

(76) Inventor: Michel Lessard, Hebertville (CA)

( * ) Notice: Subject to any disclaimer, the term of this patent is extended or adjusted under 35 U.S.C. 154(b) by 498 days.

(21) Appl. No.: 12/374,887

(22) PCT Filed: Jul. 25, 2007

(86) PCT No.: PCT/CA2007/001323

§ 371 (c)(1),
(2), (4) Date: Jun. 23, 2009

(87) PCT Pub. No.: WO2008/011714

PCT Pub. Date: Jan. 31, 2008

(65) Prior Publication Data

US 2009/0304479 A1 Dec. 10, 2009

(30) Foreign Application Priority Data

Jul. 25, 2006 (CA) ..... 2553994

(51) Int. Cl.
*B66F 9/18* (2006.01)

(52) U.S. Cl.
USPC ..... 414/620; 414/621

(58) Field of Classification Search
USPC ..... 414/618, 620–621, 624, 625, 627; 901/31, 33, 34, 39, 46, 49; 294/88, 907
See application file for complete search history.

(56) References Cited

U.S. PATENT DOCUMENTS 4,023,425 A 5/1977 Parker
4,143,558 A 3/1979 Van Deursen et al.
4,215,622 A * 8/1980 Chichester ..... 91/508
4,350,491 A 9/1982 Steuer
4,491,918 A * 1/1985 Yuki et al. ..... 701/50
4,516,905 A 5/1985 Cavin et al.
4,552,545 A 11/1985 Koivunen
4,714,399 A * 12/1987 Olson ..... 414/621
4,730,862 A * 3/1988 Caen et al. ..... 294/88
4,783,106 A * 11/1988 Nutter ..... 294/88

(Continued)

FOREIGN PATENT DOCUMENTS

CA 2035725 A1 8/1991
CA 2102324 C 4/1996

(Continued)

OTHER PUBLICATIONS

International Search Report: PCT/CA2007/001323.

*Primary Examiner* — Stephen Vu
(74) *Attorney, Agent, or Firm* — Equinox IP; Franz Bonsang

(57) ABSTRACT

A control for a load-handling device including a gripper for handling a load and being connected to pressure controlled gripping, lifting and tilting actuators The control including a pressure-sensing actuator assembly, a gripping pressure regulator and pressure control assembly. The pressure-sensing actuator assembly being is placed in pressure communication with the lifting and tilting actuators. The gripping pressure regulator regulates the gripping pressure. The pressure control assembly includes interrelated movable members for interacting with the pressure-sensing actuator assembly and for acting on the gripping pressure regulator. The pressure-sensing actuator is adapted to sense the weight of the load from the pressure of the lifting and tilting actuators and to communicate this pressure to the pressure control assembly. Thereby, interacting with the pressure control assembly as to cause to latter to so act on the gripping pressure regulator as to provide a suitable gripping pressure in response to the weight of the load.

34 Claims, 11 Drawing Sheets

(56) References Cited

U.S. PATENT DOCUMENTS

| | | | | |
|---|---|---|---|---|
| 5,052,981 | A | 10/1991 | Robert | |
| 5,458,539 | A | 10/1995 | Landry | |
| 5,468,192 | A | 11/1995 | Robbins | |
| 6,027,302 | A * | 2/2000 | Nilsson | 414/621 |
| 6,270,436 | B1 | 8/2001 | Reik et al. | |
| 6,280,357 | B1 | 8/2001 | Van Spijk | |
| 6,287,227 | B1 | 9/2001 | Vahabzadeh et al. | |
| 6,387,000 | B1 | 5/2002 | Eisenbacher et al. | |
| 6,394,920 | B1 | 5/2002 | Morlok | |
| 6,705,961 | B2 | 3/2004 | Johnson et al. | |
| 6,712,724 | B2 | 3/2004 | Katou | |
| 6,840,876 | B2 | 1/2005 | Illerhaus et al. | |
| 6,843,740 | B2 | 1/2005 | Muller et al. | |
| 6,846,255 | B2 | 1/2005 | Muller | |
| 7,018,159 | B2 * | 3/2006 | Jordan et al. | 414/636 |
| 7,056,078 | B2 * | 6/2006 | Seaberg | 414/623 |

FOREIGN PATENT DOCUMENTS

| | | | |
|---|---|---|---|
| CA | 2203351 | C | 10/1997 |
| CA | 2555839 | A1 | 10/1997 |
| EP | 0 898 096 | A1 | 2/1999 |
| EP | 0 995 557 | B1 | 4/2000 |
| WO | 2006/132986 | A3 | 12/2006 |

* cited by examiner

MECHANICAL PRESSURE CONTROL FOR A LOAD-HANDLING DEVICE

FIELD OF THE INVENTION

The present invention relates to pressure control of a load-handling device. More specifically, but not exclusively the present invention relates to an apparatus and method for controlling the gripping pressure of a load-handling device.

BACKGROUND OF THE INVENTION

Clamp-equipped load handling devices are well known. Load handling devices may be mounted to load handling vehicles such as power lift trucks for example. Such vehicles include load handling devices having a vertical mast with a clamp movably mounted thereto for upward and downward movement along the length of the mast. These types of clamp-equipped vehicles are often used in the paper and pulp industry. The clamp-equipped vehicle is intended to grip and lift one or more rolls of paper. More particularly, the truck approaches a roll and the clamps are opened so as to engaged the roll therebetween and then closed so as to grip the roll to be moved along the longitudinal length of the mast thereby lifting the paper roll load; the mast can also be simultaneously tilted between left and right directions. The clamping or gripping pressure on paper-rolls, particularly for printing presses, should not be such that the paper-roll will be squeezed to an oval shape during handling of the rolls which includes gripping, lifting and tilting thereof.

Various solutions for avoiding paper-roll ovalization have been proposed. For example, devices for controlling the clamping pressure in response to detected sliding at the gripping surface of the clamps have been provided. A drawback of these devices is that the paper-roll may be damaged during the sliding movement.

Further improvements include electrical load handling devices that monitor the lifting force of the mast via a sensor in order to adapt the clamping force exerted on the roll to the lifting force. The clamping pressure line is provided with a pressure reduction valve that is controlled by a controller (e.g. a computer) linked to the sensor. Thereby, the pressure provided by the clamping pressure line is proportional to the lifting force detected by the sensor. A drawback of such systems is that the lifting pressure may increase as the clamps gripping the paper load move up along the mast, thereby increasing the clamping pressure which may sometimes damage the paper roll. Typically, a regular sized mast can have a first lower section, where the gripping force remains as required and a second upper section, when the lifting force is greater due to the increase in pressure required for lifting a load for an even greater distance which causes the gripping force to be proportionally increased which may damage the roll since the weight of the roll has not changed. Another drawback of such systems is their cost given the fact that a relatively complex and costly array of electrical circuit regulators, sensors and data processors is needed.

OBJECTS OF THE INVENTION

An object of the present invention is to provide a control of the gripping pressure of a load-handling gripper.

SUMMARY OF THE INVENTION

In accordance with an aspect of the present invention, there is provided a control apparatus for a load-handling device including a gripper for handling a load being connected to pressure controlled gripping, lifting and tilting actuators for respectively gripping, lifting and tilting the handled load; the apparatus comprising a pressure-sensing actuator assembly for being placed in pressure communication with the lifting and tilting actuators and adapted to be actuated by the pressure exerted on the lifting and tilting actuators; a gripping pressure regulator for regulating the gripping pressure exerted on the gripping actuator; and a pressure control assembly comprising interrelated movable members for interacting with the pressure-sensing actuator assembly during actuation thereof and for acting on the gripping pressure regulator; wherein the pressure-sensing actuator is adapted to sense the weight of the load from the pressure exerted on the lifting and tilting actuators and to be accordingly actuated by this pressure thereby so interacting with the pressure control assembly as to provide for the pressure control assembly to consequently act on the gripping pressure regulator in order to provide a suitable gripping pressure in response to the weight of the load.

In accordance with another aspect of the present invention, there is provided a load-handling device comprising: a gripper for handling a load being connected to pressure controlled gripping, lifting and tilting actuators for respectively gripping, lifting and tilting the handled load; a control apparatus comprising a pressure-sensing actuator assembly in pressure communication with the lifting and tilting actuators so as to be actuated by the pressure exerted thereon; a gripping pressure regulator for regulating the gripping pressure exerted on the gripping actuator; and a pressure control assembly comprising interrelated movable members for interacting with the pressure-sensing actuator assembly during actuation thereof and for acting on the gripping pressure regulator, wherein the pressure-sensing actuator is adapted to sense the weight of the load from the pressure exerted on the lifting and tilting actuators and to be accordingly actuated by this pressure thereby so interacting with the pressure control assembly as to provide for the pressure control assembly to consequently act on the gripping pressure regulator in order to provide a suitable gripping pressure to the gripper in response to the weight of the load.

In accordance with a further aspect of the present invention, there is provided a load-handling vehicle comprising: a gripper for handling a load being connected to pressure controlled gripping, lifting and tilting actuators for respectively gripping, lifting and tilting the handled load; a control apparatus comprising a pressure-sensing actuator assembly in pressure communication with the lifting and tilting actuators so as to be actuated by the pressure exerted thereon; a gripping pressure regulator for regulating the gripping pressure exerted on the gripping actuator; and a pressure control assembly comprising interrelated movable members for interacting with the pressure-sensing actuator assembly during actuation thereof and for acting on the gripping pressure regulator; wherein the pressure-sensing actuator is adapted to sense the weight of the load from the pressure exerted on the lifting and tilting actuators and to be accordingly actuated by this pressure thereby so interacting with the pressure control assembly as to provide for the pressure control assembly to consequently act on the gripping pressure regulator in order to provide a suitable gripping pressure to the gripper in response to the weight of the load.

In an embodiment, the pressure control assembly comprises four movable members, the first movable member engaging at each longitudinal end thereof a respective one of the pair of tilting-pressure actuators, the second movable member engaging at each longitudinal end thereof the first movable member and the third movable member, the third movable member engaging at each longitudinal end thereof one of the pair of lifting-pressure actuators and the fourth said moveable member, the fourth movable member engaging at each longitudinal end thereof the other of the pair of lifting-pressure actuators and the gripping pressure regulator.

In an embodiment, then pressure control assembly comprises four movable members, the first movable member engaging at each longitudinal end thereof a respective one of the pair of tilting-pressure actuators, the second movable member engaging at each longitudinal end thereof the first movable member and one of the pair of lifting-pressure actuators, the third movable member engaging at each longitudinal end thereof the second movable member and the fourth moveable member, the fourth movable member engaging at each longitudinal end thereof the other of the pair of lifting-pressure actuators and the gripping pressure regulator.

In accordance with yet another aspect of the present invention, there is provided a control for a load-handling gripper adapted to grip, lift and tilt the load by way of gripping, lifting and tilting pressure, the control comprising; a pressure-sensing assembly for sensing the lifting and tilting pressure during load-handing of the gripper; a gripping pressure regulator for regulating the gripping pressure; and a pressure control assembly for interacting with the pressure-sensing assembly and acting on the gripping pressure regulator; wherein the pressure-sensing assembly is adapted to communicate the lifting and tilting pressures to the pressure control assembly so as to correspondingly act on the gripping pressure regulator to provide a suitable gripping pressure in response to the sensed lifting and tilting pressures.

In accordance with yet a further aspect of the present invention, there is provided a hydraulic pressure circuit for a load handling device including a gripper for handling a load being connected to gripping, lifting and tilting actuators for respectively gripping, lifting and tilting the handled load, the circuit comprising: a hydraulic fluid reservoir; hydraulic pressure lines in fluid communication with the reservoir and the gripping, lifting and tilting actuators for feeding hydraulic fluid thereto; a pressure-sensing actuator assembly in fluid communication via the pressure lines with the lifting and tilting actuators and adapted to be actuated by the pressure exerted on the lifting and tilting actuators; a gripping pressure regulator in fluid communication via the pressure lines with the gripping actuator for regulating the gripping pressure of the gripper: and a pressure control assembly comprising interrelated movable members for interacting with the pressure-sensing actuator assembly during actuation thereof and for acting on the gripping pressure regulator; wherein the pressure-sensing actuator is so actuated by the pressure exerted on the lifting and tilting actuators during handling of a load as to correspondingly interacting with the pressure control assembly as to provide for the pressure control assembly to consequently act on the gripping pressure regulator in order to provide a suitable gripping pressure in response to the weight of the load.

In accordance with still another aspect of the present invention, there is provided a method for controlling the gripping pressure of a load handling device including a gripper for handling a load being connected to gripping, lifting and tilting actuators for respectively gripping, lifting and tilting the handled load; the method comprising: providing actuators in pressure communication with the lifting and tilting actuators so as to be actuated by the pressure thereof; interfacing interrelated movable members with the actuators so as to interact therewith; providing a gripping pressure regulator in pressure communication with the gripping actuator for providing gripping pressure thereto; and interfacing the movable members with the pressure regulator so as to act thereon in response to the interactions with the actuators thereby providing a suitable pressure to the gripping actuator.

In accordance with still a further aspect of the present invention, there is provided a method for controlling the gripping pressure of a load handling device including a gripper for handling a load being connected to gripping, lifting and tilting actuators for respectively gripping, lifting and tilting the handled load; the method comprising: sensing the pressure at the lifting and tilting actuators during load handling by the gripper; mechanically computing a suitable pressure based on the sensed pressure at the lifting and tilting actuators; and providing this suitable pressure to the gripping actuator so as to grip the load with this suitable pressure.

Other objects, advantages and features of the present invention will become more apparent upon reading of the following non-restrictive description of non-limiting illustrative embodiments thereof, given by way of example only with reference to the accompanying drawings.

BRIEF DESCRIPTION OF THE DRAWINGS

In the appended drawings, where like reference numerals denote like elements throughout and in where.

DETAILED DESCRIPTION OF ILLUSTRATIVE EMBODIMENTS

With reference to the appended drawings, non-restrictive illustrative embodiments of the control for a load handling device will be described herein so as to exemplify the invention and not limit the scope thereof.

Generally stated, the present invention provides a fully mechanical, proportional pressure control for clamp-equipped load-handling devices thereby avoiding clamping induced paper roll ovalisation. The apparatus and method of the present invention provide for sensing the weight of the load from two different sources and mechanically computing a suitable gripping pressure. Adjustments are performed using a set of calibration keys. Hence, the present invention provides a gripping and lifting device with a built-in mechanical pressure control or adjustment assembly to adjust the gripping pressure thereof. The apparatus of the invention comprises a pair of tilt actuators and a lift actuator, as well as a mechanical pressure control assembly. The mechanical pressure control assembly includes interrelated or interlinked members such as balancers, which are actuated by actuators such as micro-cylinders controlled by the hydraulic pressure from the two tilt cylinders and the lifting cylinder. The clamping or gripping device is pre-set to lift an object at a given pressure; if the object is too heavy to lift with that pre-set pressure, there is a rise in the pressure of the lifting cylinder which will cause an imbalance with the pressure of the tilt cylinders. This imbalance provides a net force that is proportional to the pressure difference available to reduce the clamping pressure. Hence, the aforementioned imbalanced pressure will control a response in the interrelated mechanical adjusting balancers. The resulting force at the last mechanical balancer of the assembly will control the pressure-regulating valve in order to increase the pressure of the gripping clamp in response to increases in the lifting force.

Figure 15:
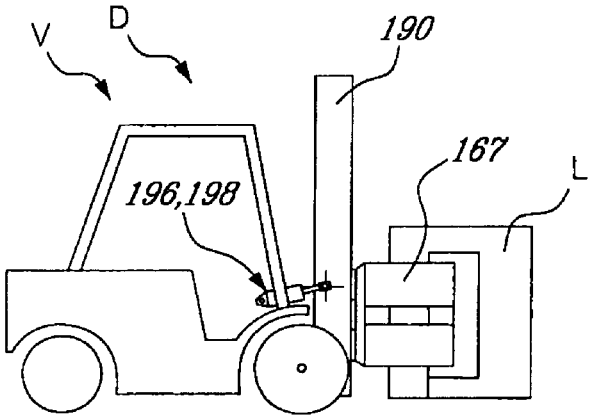
FIG. 15 is a schematic view of a load handling device including that vehicle of the invention in accordance with a non-restrictive illustrative embodiment thereof.
Figure 16:
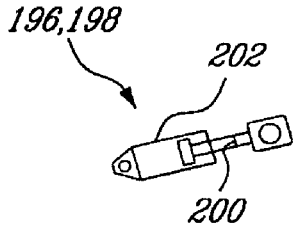
FIG. 16 is a schematic view of the tilting actuation of the load handling device of FIG. 15.

FIGS. 1, and 5 to 9 show the apparatus 10 for controlling the gripping force of a load-handling device D, such as the load handling vehicle V (as shown in FIG. 15). It should be understood that the term load handling device can include a load-handling vehicle.

Figure 3:
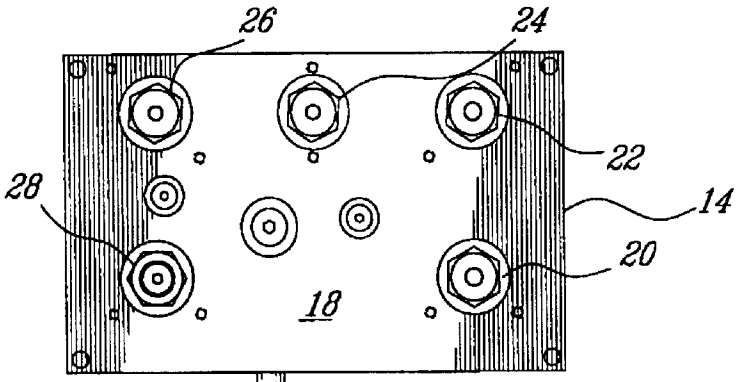
FIG. 3 is top plan view of the base of the apparatus of FIG. 1.
Figure 4:
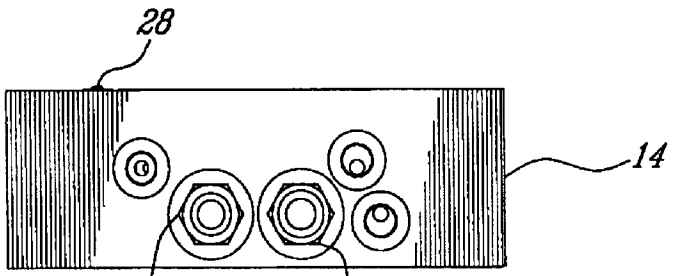
FIG. 4 is a front face view of the base of the apparatus of FIG. 1.

The apparatus 10 includes a housing 12 comprising a base 14 (see also FIGS. 3 to 4) and a cover 16 (see also FIG. 12) mounted on the top face 18 (see also FIG. 2) of the base 14.

Figure 1:
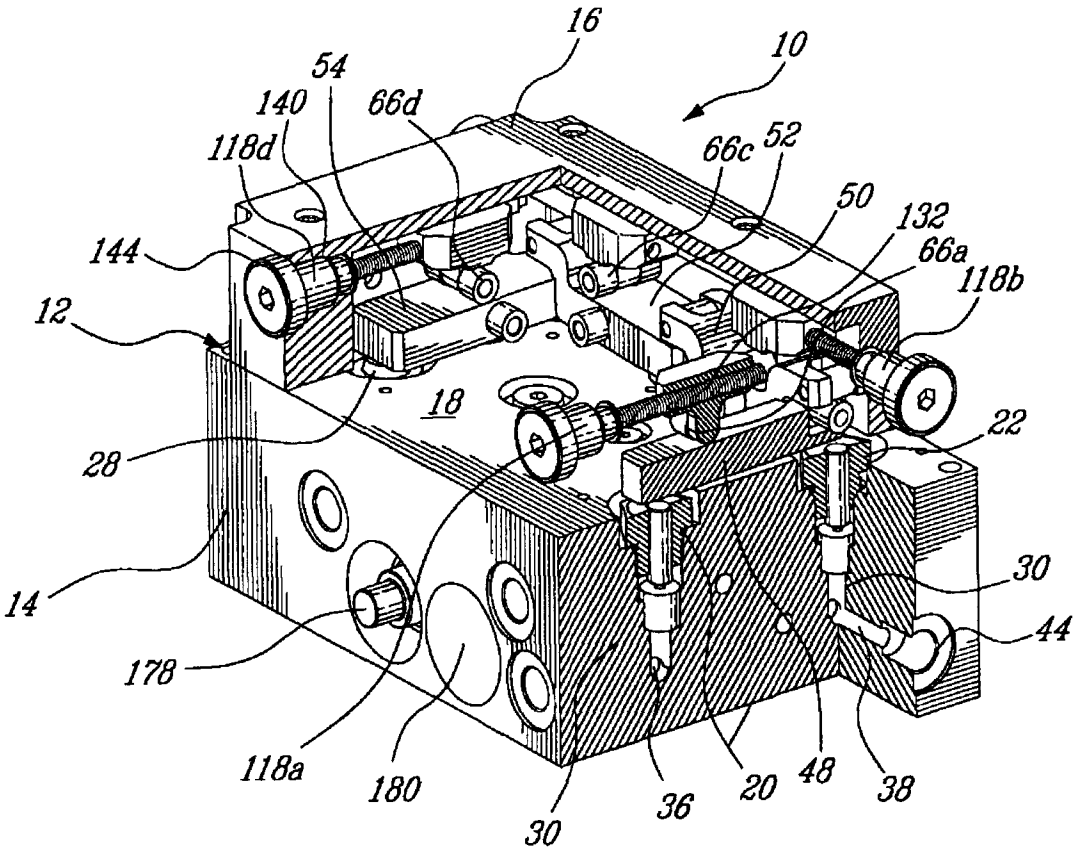
FIG. 1 is a front perspective broken view of the pressure control apparatus for a load-handling device in accordance with a non-restrictive illustrative embodiment of the present invention.
Figure 2:
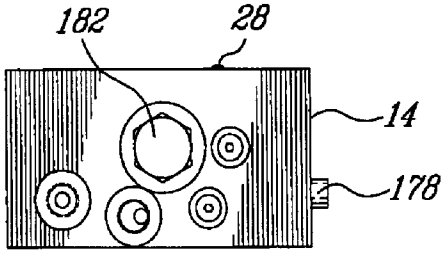
FIG. 2 is a right lateral side elevational view of the base of the apparatus of FIG. 1.
Figure 5:
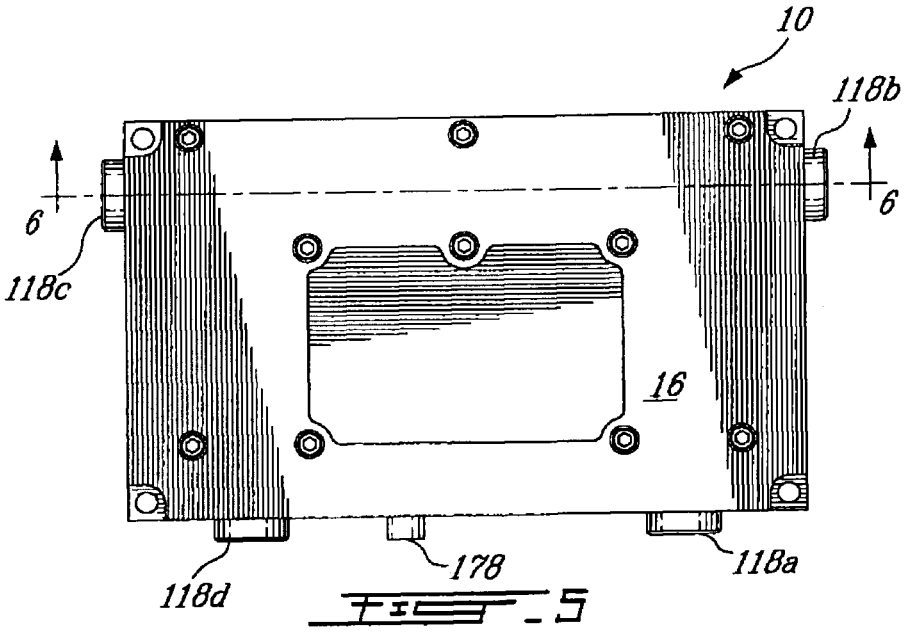
FIG. 5 is a top plan view of the apparatus of FIG. 1.

With reference to FIGS. 1 and 2, the base 14 houses a pressure-sensing actuator assembly comprising two actuator assemblies, namely a tilting-pressure sensing actuator assembly and a lifting-pressure actuator assembly. In this example, the tilting-pressure sensing actuator assembly includes a pair of tilting-pressure actuators 20 and 22 and the lifting-pressure actuator assembly includes a pair of lifting pressure actuators 24 and 26. In the present illustrative example and as better shown in FIG. 13, actuators 20, 22, 24 and 26 are in the form of hydraulic micro piston cylinders including respective cylinders 32 and pistons 34 movably mounted thereto.

The base 14 also houses a gripping pressure regulator in the form of a pressure regulating valve 28.

Turning to FIGS. 1, 6, 8 and 9, actuators 20, 22, 24 and 26 and valve 28 are positioned within longitudinal housing tunnels machined into the body of the base 14. These housing tunnels 30 are in fluid communication with hydraulic fluid pipes 36, 38, 40, 42 machined into the body of the base 14, thereby providing the actuators 20, 22, 24 and 26 and the valve 28 to be in fluid communication with these hydraulic fluid pipes. Specifically, tilting-pressure actuators 20 and 22 are in fluid communication with pipes 36 and 38 respectively; lifting-pressure actuators 24 and 26 are in fluid communication with pipe 40 via channels 40*a* and 40*b* respectively; and pressure-regulating valve 28 is in fluid communication with pipe 42. Pipes 36, 38, 40, 42 include orifices 44 for mounting fluid pressure lines thereto as is known in the art. Of course a variety of suitable fluid pipe arrangements can be contemplated by the skilled artisan.

Figure 6:
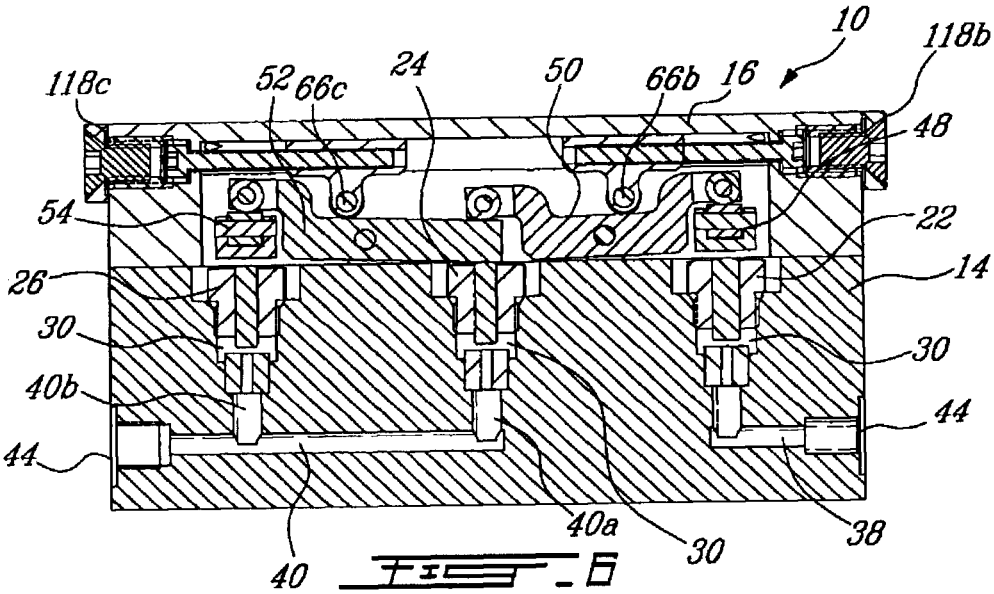
FIG. 6 is a sectional view of the apparatus along the line 6-6 of FIG. 5.
Figure 7:
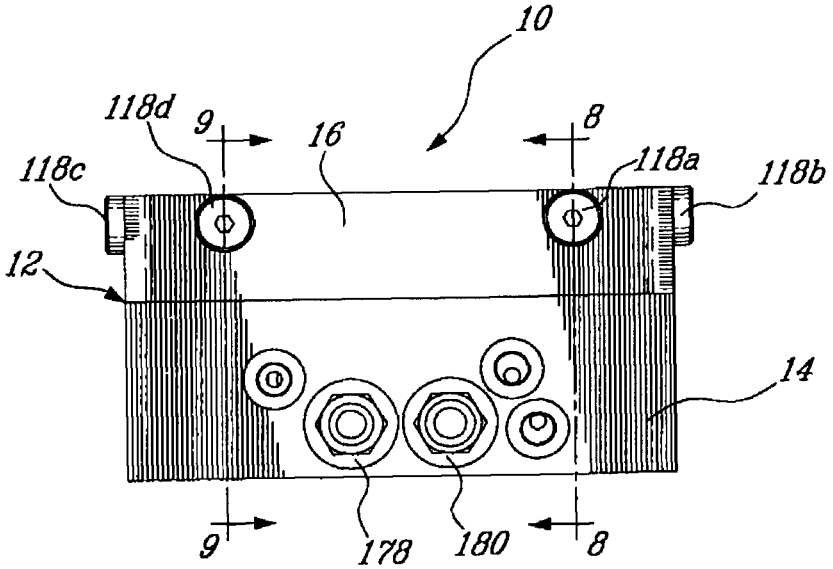
FIG. 7 is front face view of the base of the apparatus of FIG. 1.
Figure 9:
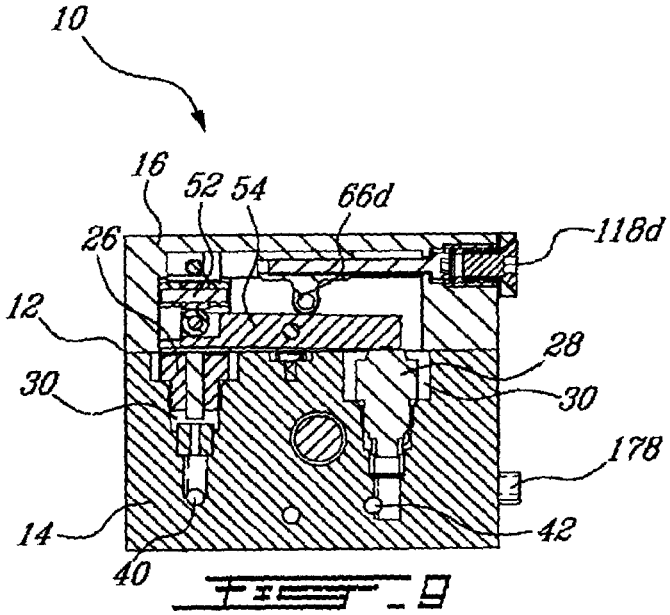
FIG. 9 is a sectional view of the apparatus along the line 9-9 of FIG. 7.

With reference to FIGS. 1, 6, 6 and 9, the cover 16 includes a pressure control assembly which includes movable interrelated members 48, 50, 52 and 54 for being interfaced and thereby interacting with actuators 20, 22, 24 and 26 and also acting on valve 28 in consequence of their interaction with the foregoing actuators. With The interrelated movable members 48, 50, 52 and 54 are in the form of balancers pivotally mounted within a horseshoe-shaped channel 56 (see FIG. 12) machined into the body of the cover 16 on the bottom or underside 57 thereof.

With reference to FIGS. 11A, 11B, 11C and 12, the balancers 48, 50, 52 and 54 will now be described in accordance with non-restrictive illustrative embodiments thereof.

Figure 11A:
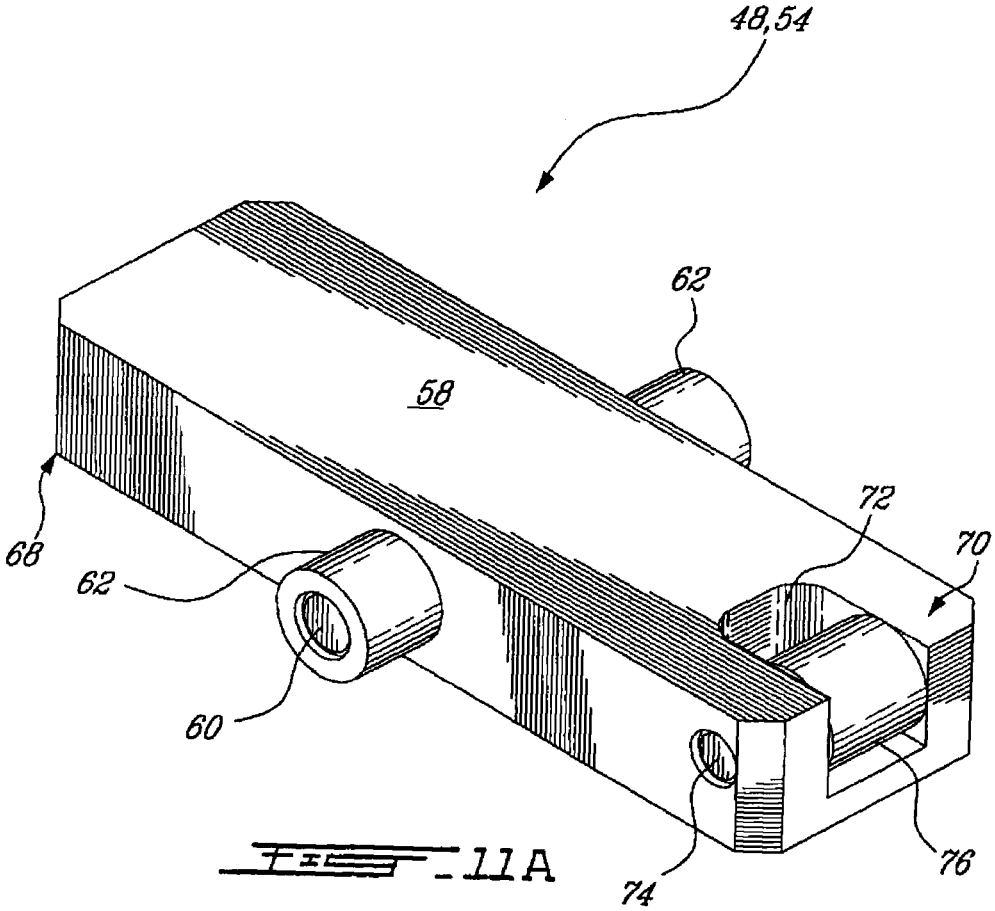
FIGS. 11*a*, 11*b* and 11*c* are perspective views of a balancer of the invention in accordance with a non-restrictive illustrative embodiment thereof.
Figure 12:
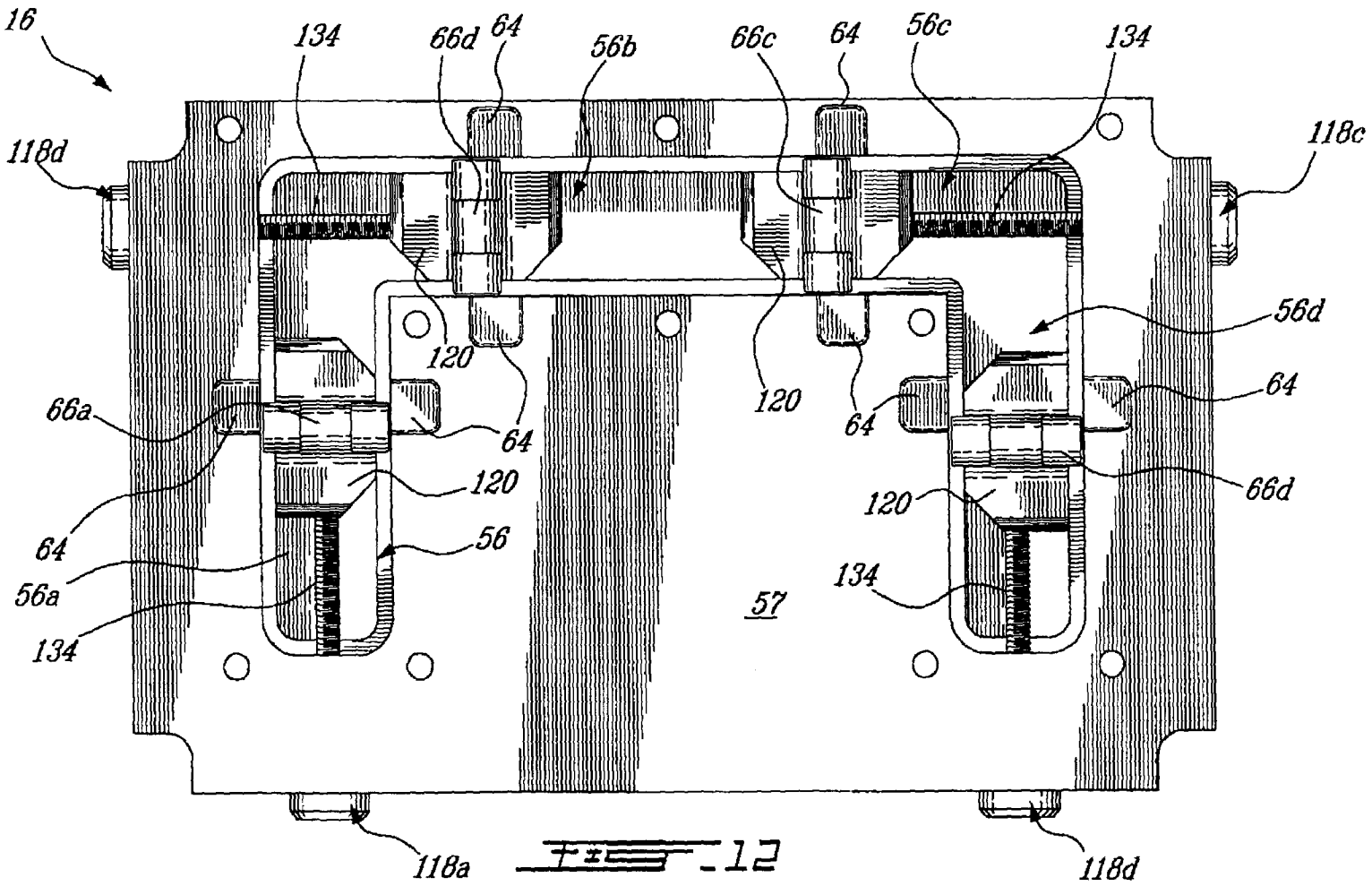
FIG. 12 is a bottom plan view of the cover of the apparatus of FIG. 1 in accordance with a non-restrictive illustrative embodiment of the present invention.

Referring to FIGS. 11A and 12, the first and fourth balancers 48 and 54 respectively are similarly constructed and configured to be positioned within portions 56*a* and 56*d* of the channel 56 respectively. The balancers 48 and 54 include a main longitudinal body 58 having a pair of lateral stems 60 protruding from each side thereof for mounting respective bearings 62 thereto which are rollingly mounted to sockets 64 thereby allowing the balancers 48 and 54 to pivot within the channel portions 56*a* and 56*d* respectively. The bodies 58 of the balancers 48 and 54 pivot about bar members 66*a* and 66*d* respectively engaged thereby and respectively positioned within the channel portions 56*a* and 56*d*. Each longitudinal body 58 includes a flat end portion 68 and an opposite end portion 70 having an top recess 72 which provides a space for a pin 74 and a needle bearing 76 mounted thereto.

Figure 8:
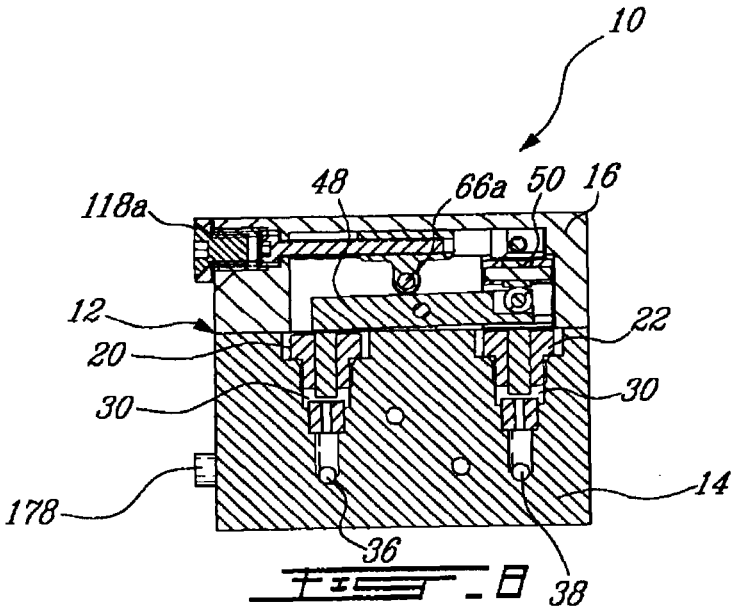
FIG. 8 is a sectional view of the apparatus along the line 8-8 of FIG. 7.

With particular reference to FIGS. 1 and 8, the bottom side of end portions 68 and 70 of the balancer 48 are respectively interfaced with piston cylinders 20 and 22.

With particular reference to FIG. 9, the bottom of end portions 68 and 70 of balancer 58 are interfaced with valve 28 and actuator 26 respectively.

Figure 11B:
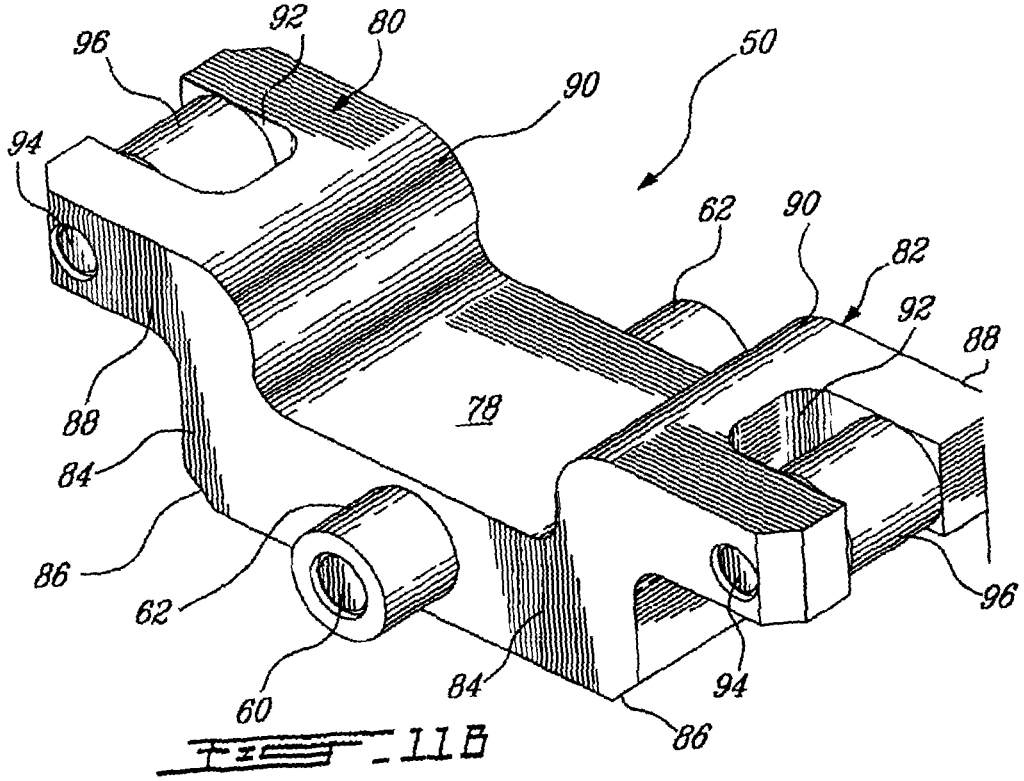

Turning now to FIGS. 11B 12, the second balancer 50 is configured to be positioned within portion 56*b* of channel 56. Balancer 50 includes a main longitudinal body 78 having a pair lateral stems 60 for receiving bearings 62 which are rollingly mounted to sockets 64 providing the balancer 50 to pivot within channel 56*b* about bar 66*b* positioned within the channel portion 56*b*. The balancer 50 includes opposite end portions 80 and 82 flanking the main body 78 at each longitudinal end thereof and forming respective s-shaped structures therewith. Each end portion 80 and 82 includes a section 84 upwardly extending from the main body 78 thereof and forming an elbow 86 therewith. Each extending section 84 has a head section 88 protruding therefrom forming a shoulder 90 therewith. Each head section 88 includes a front recess 92 which provides a space for a pin 94 and a needled bearing 96 mounted thereto.

With particular reference to FIG. 6, the end portion 80 of balancer 50 is interfaced with the top side of portion 70 of the balancer 48 and the end portion 82 of balancer 50 is interfaced with the top side of portion 100 (see FIG. 11C) of balancer 52. The bearings 96 and 76 provide for a mutual rolling engagement, bearing 96 provides for a rolling engagement of the top side of portion 100 of balancer 52.

Figure 11C:
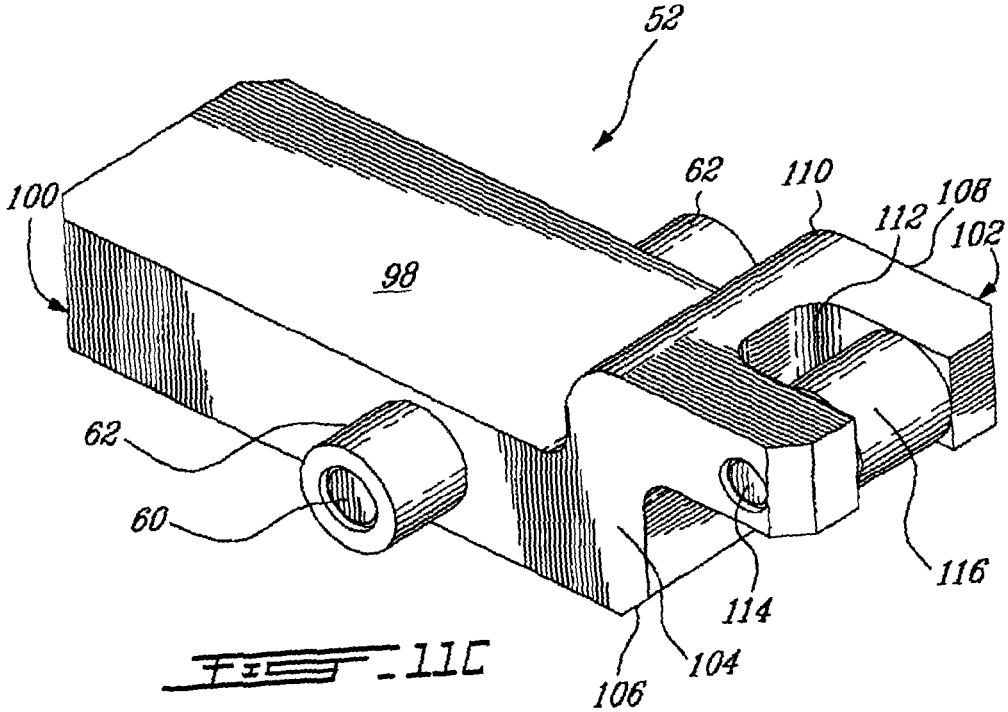

Turning now to FIGS. 11C and 12, the balancer 52 is configured to be positioned within portion 56*c* of channel 56. Balancer 52 includes a main longitudinal body 98 having a pair lateral stems 60 for receiving bearings 62 which are rollingly mounted to sockets 64 providing the balancer 50 to pivot within channel 56*c* about bar 66*c* positioned within the channel portion 56*c*. The balancer 52 includes a flat end portion 100 and an opposite end portion 102 forming an s-shaped structure with the main body 98. This s-shaped structure includes a section 104 upwardly extending from the main body 98 forming an elbow 106 therewith. Section 104 includes a head section 108 protruding therefrom so as to form a shoulder 110 therewith. The head section 108 includes a front recess 112 which provides a space for a pin 114 and a needled bearing 116 mounted thereto.

With particular reference to FIG. 6, the bottom side of the flat end portion 100 of balancer 52 is interfaced with actuator 24 and the top side of this flat end portion is interfaced with the bottom side of end portion 82 of balancer 50. The bottom side of the end portion 102 of balance 52 is interfaced with the top side of end portion 70 of balancer 54. The bearings 76, 96 and 116 allow for a rolling slidable engagement between the balancers 50, 52 and 54.

Without the bar members 66*a*, 66*b*, 66*c* and 66*d*, the pivot axis of each balancer 48, 50, 52, and 54 is defined by their respective lateral side stems 60. Yet, these pivot axis can be altered as will be explained below.

Figure 10:
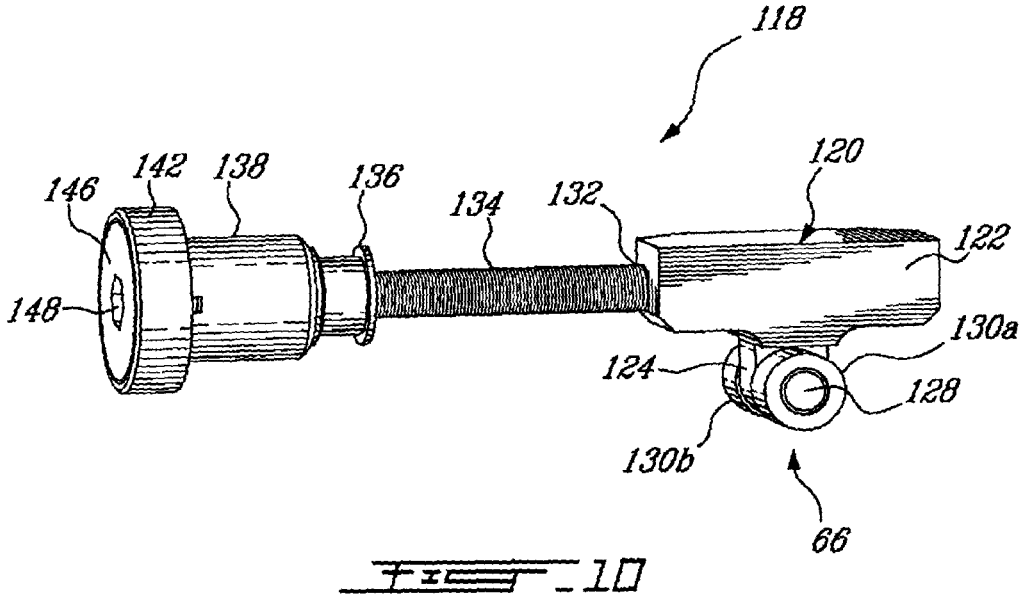
FIG. 10 is a perspective view of an adjustment key of the invention in accordance with a non-restrictive illustrative embodiment thereof.

In that sense and with particular reference to FIGS. 10 and 12, the support bar members 66*a*, 66*b*, 66*c* and 66*d* generally denoted 66 in FIG. 10 and briefly mentioned above are each respectively a part of adjustment mechanisms 118*a*, 118*b*, 118*c* and 118*d* (see also FIGS. 1 and 5 to 9) for adjusting the pivot axis of balancers 48, 50, 52 and 54 respectively. The adjustment mechanisms 118*a*, 118*b*, 118*c* and 118*d* are generally denoted 118 in FIG. 10 and are all similarly constructed. More specifically, in this non-limiting example, each mechanism 118 is a pivot axis adjustment assembly including a carriage 120 that is snuggly yet slidably mounted within the channel 56 of the cover 14. Specifically, each channel portion 56*a*, 56*b*, 56*c* and 56*d* includes a carriage 120. The carriage 120 includes a base 122 having the support bar 66 protruding therefrom. The support bar 66 is defined by a protrusion 124 having an aperture (not shown) for receiving a stem 128 therethrough on which a pair of bearings 130*a* and 130*b* are mounted on each side of the protrusion 124. The balancers 48, 50, 52 and 54 pivot on the these bearings 130*a* and 130*b* and protrusions 124. The carriage base 122 includes an internally threaded bore 132 (see FIG. 1) for receiving a complementary threaded screw shaft 134 therethrough. The screw shaft 134 is engaged by tapered washers 136 at its opposite end which provide for mounting the screw shaft 134 within a threaded insert 138 that is positioned within a tunnel 140 (see FIG. 1) machined into the body of the cover 16. The threaded insert 138 is connected to a thrust washer 142 via opening 144 (see FIG. 1). The head 146 of the screw shaft 134 is positioned through opening 144 and includes a drive keyslot 148 for receiving a key (not shown) when actuating the threaded screw shaft 134.

Actuation of the screw shaft 134 causes mutual interference between the complementary threads of shaft 134 and of the bore 132 providing for slidably moving the carriage 120 within a particular section of the channel 56 along the longitudinal length of the shaft 134 thereby repositioning the support bar 66 and hence, modifying the pivot movement of a given balancer 48, 50, 52 and 54 within their respective channel portion 55*a*, 56*b*, 56*c* and 56*d*; in fact, the position of the pivot axis of each balancer is displaced.

Figure 14:
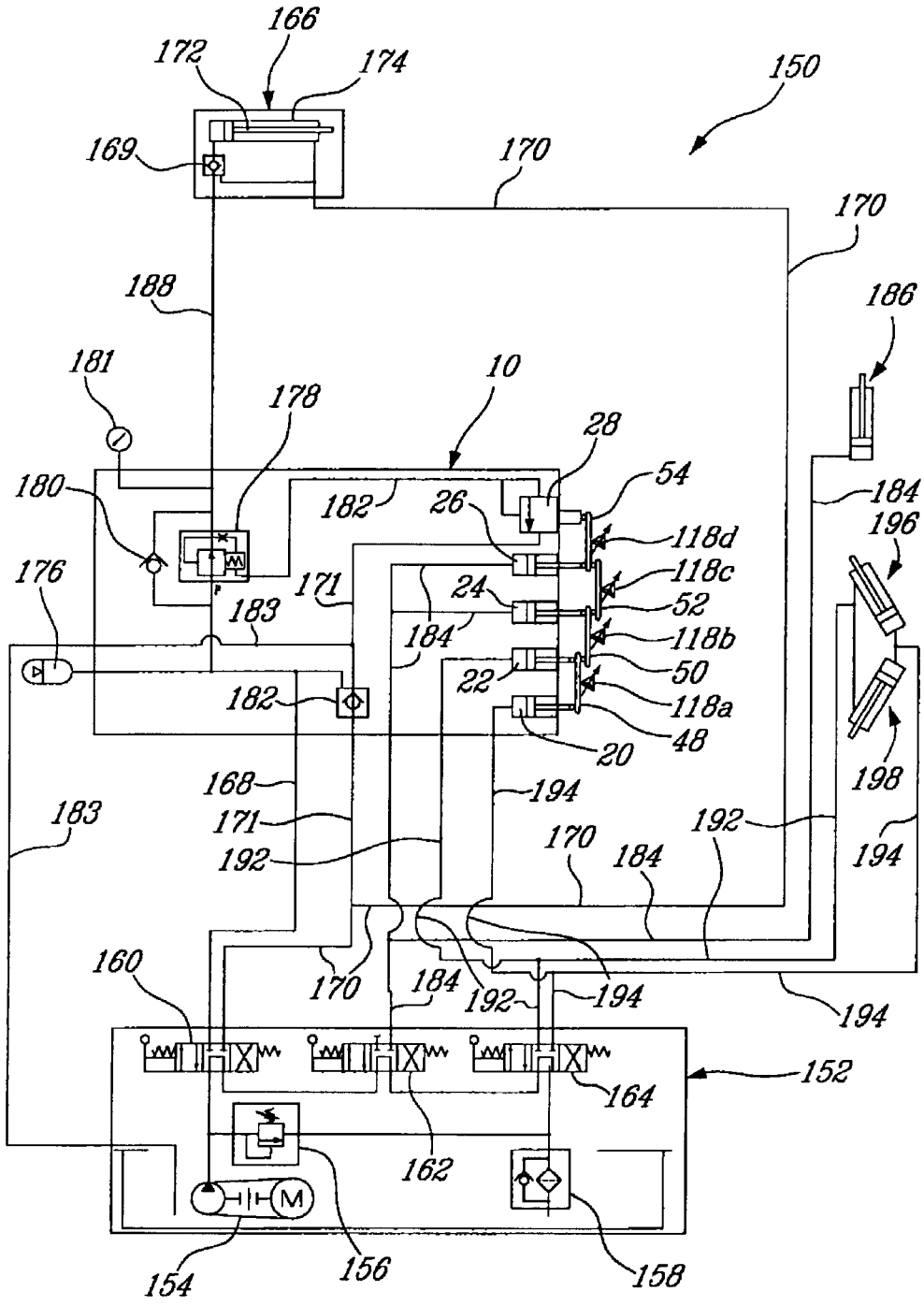
FIG. 14 is a schematic representation of the hydraulic circuit of the invention in accordance with a non-restrictive illustrative embodiment thereof.

With particular reference to FIG. 14, the hydraulic circuit 150 of the invention will now be described in accordance with a non-restrictive illustrative embodiment thereof.

A hydraulic reservoir controller 152 is mounted to the load handling vehicle V (see FIG. 15) and includes a drive source 154 having a motor M, a security pressure relief valve 156 and check valve with filter 158 as well as three directional valves 160, 162 and 164.

The first directional valve 160 sends hydraulic fluid to the gripper actuator 166 in the form of a piston cylinder for controlling the gripper 167 (see FIG. 15) in the form of clamps. Two pressure lines communicate with directional valve 160, namely a gripping or clamping pressure line 168 and an ungripping or unclamping pressure line 170.

The clamping pressure line 168 feeds fluid to the clamp piston cylinder 166 causing the piston rod 172 thereof to exit its cylinder 174, thereby causing the clamps 167 to grip the load L (see FIG. 15). More particularly, fluid in the clamping pressure line 168 flows therein from the directional valve 148 which is fed from the hydraulic reservoir (not shown but placed within the vehicle V) to be compressed by compressor 176 and then to be regularized by the pilot valve 178 (see also FIGS. 1 to 9). The pilot valve 178 is pre-adjusted so as to provide a predetermined pressure or preload. A check valve 180 (see also FIGS. 1, 4 and 7) is positioned next to the pilot valve 178 so as not to allow fluid to be fed back into the clamping line 168. The fluid then flows to the clamp piston cylinder 166. The operator can read the gripping pressure via a manometer 181.

The pressure-regulating valve 28 adds additional pressure, if need be, to the pilot valve 178 via conduit line 182. During clamping the check valve 182 (see also FIG. 2) is open providing hydraulic fluid to the valve 28 via conduit 171 which is in fluid communication with pressure line 170. Excess fluid flows back into the reservoir via conduit 183.

When the operator wishes to unclamp clamps 167, the first directional valve 160 feeds the unclamping pressure line 170 with fluid, the check valve 182 is closed thereby arresting fluid from traveling within conduit 171 and in this way fluid is forced to reach the clamp piston cylinder 156 from the opposite side thereof pushing the piston rod 172 back into the cylinder 174 causing the clamps 167 to open.

Figure 17:
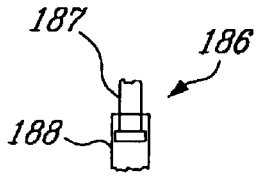
FIG. 17 is a schematic view of the lifting actuator of the load handling device of FIG. 15.

The second directional valve 162 feeds a lift pressure line 182 which is in fluid communication with both the lifting actuator 186 (see also FIG. 17) shown in this example in the form of a piston cylinder and with the lifting pressure actuators 24 and 26 which act on the lifting piston cylinder 186. Hence, fluid flows from the directional valve to the lift piston cylinder 186 pushing the piston rod 187 out of cylinder 188 thereby lifting the clamps 167 along the mast 190 (see FIG. 15).

The third directional valve 164 feeds a pair of tilt pressure lines 192 and 194. Pressure line 194 is in communication with tilting pressure actuator 20 and with a tilting actuator comprising with a pair of tilt piston cylinders 196 and 198 (see also FIGS. 14 and 15) which act on the mast 190 for tilting movement thereof. Pressure line 194 feeds the tilt piston cylinders 196 and 198 causing their respective piston rods 200 to exit their respective cylinders 202. Pressure line 192 is in communication with tilting pressure actuator 22 and with the pair of tilt piston cylinders 196 and 198 for feeding thereof causing their respective piston rods 200 to enter into their respective cylinders 202.

Also shown in FIG. 14, is the schematic layout of the apparatus 10 including the interrelated movable members 48, 50, 52 and 54 interfaced with actuators 20, 22, 24, and 26 and valve 28 as well as the pivot axis adjustment assemblies 118*a*, 118*b*, 118*c*, and 118*d*.

Figure 13:
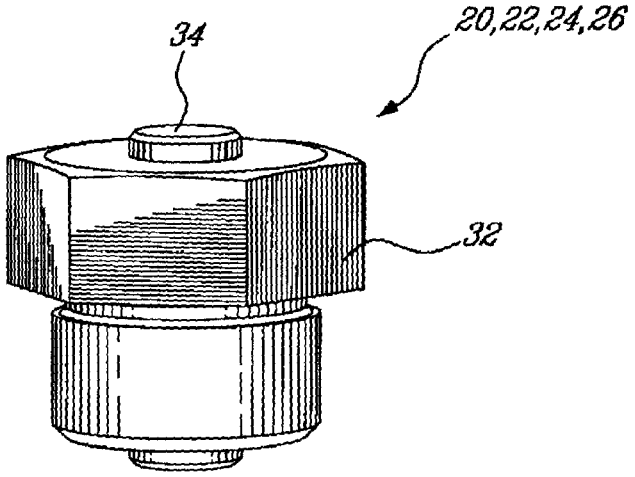
FIG. 13 is a perspective view of an actuator of the invention in accordance with a non-restrictive illustrative embodiment thereof.

It should be noted that in the example shown in FIG. 13 and contrary to FIGS. 1, 6, 8 and 9, the second movable member 50 engages the first movable 48 and the actuator 24 rather than the third movable member 52. Moreover, the third movable member 52 engages both the second and the fourth movable members rather than the actuator 24 directly. In such an arrangement, the balancer of FIG. 11C will be the second balancer having the end portion 102 thereof engaging the first balancer 48 and the balancer of FIG. 11B will be the third balancer. This is merely to show that the moveable members of the invention can be arranged in a variety of ways. Hence, even thought the structural arrangement of the balancers 48, 50, 52 and 54 is altered the functional arrangement remains the same such that when describing the invention in operation the configurations and arrangements of FIGS. 1, 6, 8 and 9 or FIG. 13 are applicable.

Hence in operation, the adjustment assembly 118*a* is so adjusted as to provide a pivot axis for the first balancer 48 which allows it to maintain its equilibrium for any pressure applied to either side (i.e. lines 192 and 194) of the tilt piston cylinders 196 and 198 provided that there is no external force (other than that provide by pressure lines 192 and 194) exerted on the piston cylinders 196 and 198. More specifically, when the balancer 48 is actuated by the movement of either the tiling-pressure actuators 20 and 22, which are in pressure communication with the tilt piston cylinders 196 and 198, it will so pivot, given the position of bar 66*a*, and act on actuators 20 and 22 as to bring the two piston cylinders 196 and 198 in pressure equilibrium. Hence, the balancer 48 acts; against the outward movement of the pistons 34 of the actuators 20 and 22 finding a middle ground between the two. As soon as there is an external force exerted on the piston cylinders 196 and 198, specifically a tension on the piston rods 200, the aforementioned balance is broken and in consequence, the second tilting-pressure actuator 22 rises against the balancer 48. This external force is caused during lifting.

The pivot axis adjustment assembly 118*b* provides for the pivot axis of the second balancer 50 to be such that for any type of load L handled by the load handling vehicle L, the surplus pressure that causes the rising of actuator 22 is compensated by the lifting pressure acting against lift-pressure actuator 24. Hence, along a first given section of the mast 190, the balancers 48 and 50 are in equilibrium. More specifically and recapitulating, when the operator actuates the lifting piston cylinder 186, this external force will break the equilibrium between tilt-pressure actuators 20 and 22 and hence, the equilibrium of the first balancer 48. The second balancer 50 is actuated at one end by the first balancer 48 and at the other end by the lift-pressure actuator 24 which is in pressure communication with the lifting piston cylinder 186. Hence, given the position of the bar 66*b*, the balancer 50 will so pivot as to bring the actuator 24 and the balancer 48 (and by extension the actuator 22) in equilibrium by acting against the rising movement of each pressure actuator 24 and 22. Therefore, when the pivot axis adjustment assembly 118*b* is adjusted as explained above, the second balancer 50 is in equilibrium allowing the third balancer 52 to be in a "floating" state having no effect on the fourth balancer 54.

During lifting of the clamps 167 and load L along a given first portion of the mast 190, it is only the pressure from the lift piston cylinder 186 that has an effect on the gripping force of clamps 167 The pivot axis adjustment assembly 118*d* is so adjusted as to provide a pivot axis for the fourth balancer 54 to pivot in accordance with the increased gripping pressure required in proportion to the weight of the load L that is being handled. Basically, all the force applied on balancer 54 by actuator 26 is transferred to the pressure valve 28 in accordance with the proportion regulated by the position of bar 66*d*. When the clamps 167 with the load L are moved to a second upper section of the mast 190, the lifting pressure at piston cylinder 186 is increased breaking the equilibrium of the second balancer 50. This is due to the fact that a residual pressure that is proportional to the difference in the lifting pressure needed at a first lower section of the mast 190 with the pressure needed at a second higher section of the mast 190 becomes available at actuator 24 causing to rise against the second and third balancers 50 and 52. This imbalance is solved since the pivot axis adjustment assembly 118*c* is adjusted as to so position bar 66*c* in order to provide a pivot axis which allows; the balancer 52 to so pivot as to act against actuator 26 in such a way as to minimize the effect of the aforementioned variation in lifting pressure along the height of the mast 190 on the valve 28. More specifically, the actuator 24 acts against balancer 52 to so pivot about bar 66*c* as to act against actuator 26 minimizing the action of the fourth balancer 54 on valve 28. As previously described, lifting-pressure actuators 24 and 26 are in pressure communication with the lift piston cylinder 186 and simultaneously act against balancer 52 at both longitudinal ends thereof as it pivots about bar 66*c* thereby providing a pressure balance between lifting-pressure actuators 24 and 26.

When the above pressure balance 24 and 26 is attained the resulting force of actuator 26 acts against balancer 54 which so pivots about bar 66*d* as to act against valve 28 in such a way as for valve 28 to provide the required additional pressure to the pilot valve 172 so as to adjust the gripping pressure applied by clamps 166 on the load L accordingly.

Hence, various gripping pressures can be attained in light of the pressure at the lifting actuator 186 and the tilting actuators 196 and 198 depending on the predetermined position of the pivot bar members 66*a*, 66*b*, 66*c* and 66*d*.

As mentioned before the pilot valve 178 controls the maximum gripping pressure of the clamp piston cylinder 166. The pilot valve can be pre-set to provide a predetermined pressure. As mentioned above, additional pressure to the pilot valve 178 is provided by pressure-regulating valve 28.

The check valve 182 allows for fluid to flow in the opposite direction during the opening of clamps 167. In order to allow for pressure readjustments as well as to allow the circuit 150 to apply the same force on the load L being handled in the event of deformation thereof, the check valve 182, whose opening is caused as soon as it detects a sufficient and predetermined pressure in the circuit 150 related to the closing of the clamps 167, provides for the clamps 167 to freely close by making possible the return of fluid to the reservoir without any other manual control required on the part of the operator.

The compressor 180 provides for additional pressure within the circuit 150 without any intervention by the operator. This may be necessary when the load handling vehicle V hits a bump while it is moving causing a vertical acceleration to be added to the horizontal acceleration of the vehicle V thereby momentarily increasing the weight of the load L provoking an automatic response from the compressor 180 that provides an additional pressure proportional to that which is needed to avoid for the load L to slide through the clamps 167.

Summarily recapitulating, the operator approaches approached the load-handling vehicle towards a load L and opens the clamps 167 so that they engage this load. A predetermined gripping pressure has been provided by the pilot valve 178 to the clamps 167. If the weight of the load L is such that a greater gripping pressure is required than that of the predetermined pressure, the tilting actuators 196 and 198 as well as the lifting actuator 186 will sense this weight and be under increased pressure, this increased pressure will be signaled to the tilting-sensing actuators 20 and 22 and to the lifting sensing actuators 24 and 26 which will so interact with the balancers 48, 50, 52 and 54 (whose pivot axis has been previously adjusted) as to cause a sum response on valve 28 in order to provide a sufficient pressure to the clamps 167 to properly grip the load L while substantially avoiding ovalization in the case of a paper roll load. As the clamps 167 and the load L are lifted to an upper portion of the mast 190, the pressure on the lifting actuator 186 is increased (as is typically known in the art) yet the weight of the load L has not changed. This increased pressure in the lifting actuator 186 is signaled to the lifting-pressure actuators 24 and 26 which interact with balancer 52 which as previously explained re-balances the pressure between these two lifting-pressure actuators 24 and 26 so as to minimize the effect of balancer 54 on valve 28. This avoids any extra unneeded pressure by clamps 167, since the weight of the load L did not change.

As such, the balancers 48, 50, 52 and 54 provide for balancing the lifting-pressure actuators 24 and 26, and the tilting-pressure actuators 20 and 22, as well as balancing the lifting-pressure actuators 24 and 26 with the tilting-pressure actuators 20 and 22 and in the process so interrelating with one another as to act on the valve 28 in order to apply a suitable gripping pressure to a load L in response to the weight of the load.

Hence, the present invention also provides a method for controlling the gripping pressure of a load handling device D or V. The method comprises sensing the pressure at the lifting 186 and tilting actuators 196 and 198 during load handling by the gripper 167, mechanically computing a suitable pressure based on the sensed pressure at the lifting 186 and tilting actuators 196 and 198, and providing this suitable pressure to the gripping actuator 166 so as to grip the load L with the suitable pressure.

Having now described the invention by way of non-restrictive illustrative embodiments, other non-illustrated embodiments will now be generally discussed so as to further exemplify the invention and not limit the scope thereof.

The housing 12 of the apparatus can be provided in a variety of suitable configurations and materials as will be understood by the person having skill in the art.

The pressure-sensing assembly can be provided in a variety of suitable configurations so as to be in pressure communication with the lifting and tilting pressures during load handling in order to communicate this pressure to the pressure control assembly so as to correspondingly act on the gripping pressure regulator to provide suitable gripping pressure to the gripper. In that respect the tilting-pressure sensing actuator assembly can be provide with a plurality of tilting-pressure actuators in pressure communication by various hydraulic, pneumatic methods or other suitable methods to sense the pressure of the tiling actuator which can also be provided in various suitable models. Likewise, the lifting-pressure sensing actuator assembly can be provide with a plurality of lifting-pressure actuators in pressure communication by various hydraulic, pneumatic methods or other suitable methods to sense the pressure of the lifting actuator which can also be provided in various suitable models.

The pressure control assembly including the movable members thereof and the pivot axis adjustments therefore can be provided by various constructions within the context of the present invention. In fact, the movable members need not pivot and may be movable associated in a variety of ways to mechanically transfer the communicated pressure from the lifting and tiling actuators to the gripping actuator in response to the weight of the load It should be noted that the various components and features of the apparatuses, device, vehicle, circuits and methods described above can be combined in a variety of ways so as to provide other non-illustrated embodiments within the scope of the invention.

It is to be understood that the invention is not limited in its application to the details of construction and parts illustrated in the accompanying drawings and described hereinabove. The invention is coverable of other embodiments and of being practiced in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention as defined in the appended claims.

What is claimed is:

1. A control apparatus for a load-handling device including a gripper for handling a load being connected to pressure controlled gripping, lifting and tilting actuators for respectively gripping, lifting and tilting the handled load; said control apparatus comprising a pressure-sensing actuator assembly for being placed in pressure communication with the lifting and tilting actuators and adapted to be actuated by the pressure exerted on the lifting and tilting actuators;

a gripping pressure regulator for regulating the gripping pressure exerted on the gripping actuator; and a pressure control assembly comprising interrelated movable members defining a respective pivot axis for interacting with said pressure-sensing actuator assembly during actuation thereof and for acting on said gripping pressure regulator, the pivot axis of each said movable member being adjustable;

wherein said pressure-sensing actuator is adapted to sense the weight of the load from the pressure exerted on the lifting and tilting actuators and to be accordingly actuated by this pressure thereby so interacting with said pressure control assembly as to provide for said pressure control assembly to consequently act on said gripping pressure regulator in order to provide a suitable gripping pressure in response to the weight of the load.

2. A control apparatus according to claim 1, wherein said pressure-sensing actuator assembly comprises a lifting-pressure sensing actuator assembly for being placed in pressure communication with the lifting actuator of the load handling device, and a tilting-pressure sensing actuator assembly for being placed in pressure communication with the tilting actuator of the load handling device.

3. A control apparatus according to claim 2, wherein said lifting-pressure sensing actuator assembly comprises a pair of lifting-pressure actuators.

4. A control apparatus according to claim 2, wherein said tilting-pressure sensing actuator assembly comprises a pair of tilting-pressure actuators.

5. A control apparatus according to claim 4, wherein said tilting-pressure sensing actuator assembly comprises a pair of tilting piston cylinders, each tiling piston cylinder being in communication with said pair of tilting-pressure actuators via first pressure and second pressure lines respectively, said first pressure line being in communication with one of said pair of tilting pressure actuators and providing pressure to the piston cylinders for moving the piston rods thereof out of their cylinders, said second pressure fine being in communication with the other of said pair of tilting-pressure actuators and providing pressure to the tilting piston cylinders for moving the piston rods thereof into their cylinders.

6. A control apparatus according to claim 4, wherein said pressure control assembly comprises four said movable members, a first said movable member engaging at each longitudinal end thereof a respective one of said pair of tilting-pressure actuators, a second movable member engaging at each longitudinal end thereof said first movable member and a third said movable member, said third movable member engaging at each longitudinal end thereof one of said pair of lifting-pressure actuators and a fourth said moveable member, said fourth movable member engaging at each longitudinal end thereof the other of said pair of lifting-pressure actuators and said gripping pressure regulator.

7. A control apparatus according to claim 6, wherein said movable members are pivotable.

8. A control apparatus according to claim 7, wherein the pivot axis of each said pivotable member is adjustable.

9. A control apparatus according to claim 7, wherein each said pivotable member is pivotable about a respective bar member defining said pivot axis.

10. A control apparatus according to claim 9, wherein said bar member is movable so as to adjust the pivot axis of said pivotable member.

11. A control apparatus according to claim 10, wherein said bar member is mounted to a carriage comprising a threaded bore to be engaged by a complementary threaded screw shaft for movement of said carriage.

12. A control apparatus according to claim 6, wherein said movable members comprise pivotable balancers.

13. A control apparatus according to claim 6, wherein the load handling device is pre-set to grip and lift the load at a predetermined pressure, wherein when there is a rise in the lifting pressure of the lifting actuator beyond said predetermined pressure, a pressure imbalance is caused between the pressures of the lifting and titling actuators, said pressure imbalance causing said pair of lifting-pressure actuators and said pair of tilting-pressure actuators to so interact with said first, second and third interrelated movable members as to provide a sum force on said fourth movable member which is transferred to said gripping pressure regulator so as to provide a suitable increase in the gripping pressure.

14. A control apparatus according to claim 4, wherein said pressure control assembly comprises four said movable members, a first said movable member engaging at each longitudinal end thereof a respective one of said pair of tilting-pressure actuators, a second movable member engaging at each longitudinal end thereof said first movable member and one of said pair of lifting-pressure actuators, a third said movable member engaging at each longitudinal end thereof said second movable member and a fourth said moveable member, said fourth movable member engaging at each longitudinal end thereof the other of said pair of lifting-pressure actuators and said gripping pressure regulator.

15. A control apparatus according to claim 1, wherein said gripping pressure regulator comprises a valve.

16. A control apparatus according to claim 1, wherein said pressure-sensing actuator assembly and said gripping pressure regulator are in communication with the lifting, tilting and gripping actuators via pressure lines.

17. A control apparatus according to claim 16, wherein said pressure lines provide hydraulic fluid pressure to the lifting, tilting and gripping actuators.

18. A control apparatus according to claim 1, wherein said movable members comprise pivotable balancers.

19. A control apparatus according to claim 18, wherein said pressure control assembly comprises four pivotable balancers.

20. A control apparatus according to claim 1, further comprising a housing for housing said pressure-sensing actuator assembly, said gripping pressure regulator, and said pressure control assembly.

21. A control apparatus according to claim 20, wherein said housing comprises a base for housing said pressure sensing actuator assembly and said gripping pressure regulator and a cover for housing said pressure control assembly, said cover being mounted to said base thereby providing said pressure control assembly to interface with said pressure sensing actuator assembly and said gripping pressure regulator.

22. A control apparatus according to claim 20, wherein said housing comprises hydraulic pipes for communicating with said pressure sensing actuator assembly and said gripping pressure regulator said hydraulic pipes being placed in hydraulic communication with the gripping, lifting and tilting actuators via hydraulic pressure lines.

23. A load-handling device comprising:

a gripper for handling a load being connected to pressure controlled gripping, lifting and tilting actuators for respectively gripping, lifting and tilting the handled load;

a control apparatus comprising a pressure-sensing actuator assembly in pressure communication with said lifting and tilting actuators so as to be actuated by the pressure exerted thereon; a gripping pressure regulator for regulating the gripping pressure exerted on said gripping actuator; and a pressure control assembly comprising four interrelated longitudinal movable members defining a respective pivot axis for interacting with said pressure-sensing actuator assembly during actuation thereof and for acting on said gripping pressure regulator;

wherein said pressure-sensing actuator is adapted to sense the weight of the load from the pressure exerted on said lifting and tilting actuators and to be accordingly actuated by this pressure thereby so interacting with said pressure control assembly as to provide for said pressure control assembly to consequently act on said gripping pressure regulator in order to provide a suitable gripping pressure to said gripper in response to the weight of the load.

24. A load-handling device according to claim 23, wherein said pressure-sensing actuator assembly comprises a lifting-pressure sensing actuator assembly in pressure communication with said lifting actuator, and a tilting-pressure sensing actuator assembly in pressure communication with said tilting actuator.

25. A load-handling device according to claim 24, wherein said lifting-pressure sensing actuator assembly comprises a pair of lifting-pressure actuators.

26. A load-handling device according to claim 24, wherein said tilting-pressure sensing actuator assembly comprises a pair of tilting-pressure actuators.

27. A load-handling device according to claim 26, wherein said tilting-pressure sensing actuator assembly comprises a pair of tilting piston cylinders, each said tiling piston cylinder being in communication with said pair of tilting-pressure actuators via first pressure and second pressure lines respectively, said first pressure line being in communication with one of said pair of tilting pressure actuators and providing pressure to said piston cylinders for moving the piston rods thereof out of their cylinders, said second pressure fine being in communication with the other of said pair of tilting-pressure actuators and providing pressure to said tilting piston cylinders for moving the piston rods thereof into their cylinders.

28. A load-handling device according to claim 26, wherein a first said movable member engaging at each longitudinal end thereof a respective one of said pair of tilting-pressure actuators, a second movable member engaging at each longitudinal end thereof said first movable member and a third said movable member, said third movable member engaging at each longitudinal end thereof one of said pair of lifting-pressure actuators and a fourth said moveable member, said fourth movable member engaging at each longitudinal end thereof the other of said pair of lifting-pressure actuators and said gripping pressure regulator.

29. A load-handling device according to claim 28, wherein said load handling device is preset to grip and lift the load at a predetermined pressure, wherein when there is a rise in the lifting pressure of said lifting actuator beyond said predetermined pressure, a pressure imbalance is caused between the pressures of said lifting and titling actuators, said pressure imbalance causing said pair of lifting-pressure actuators and said pair of tilting-pressure actuators to so interact with said first, second and third interrelated movable members as to provide a sum force on said fourth movable member which is transferred to said gripping pressure regulator so as to provide a suitable increase in the gripping pressure of said gripper.

30. A load-handling device according to claim 26, wherein a first said movable member engaging at each longitudinal end thereof a respective one of said pair of tilting-pressure actuators, a second movable member engaging at each longitudinal end thereof said first movable member and one of said pair of lifting-pressure actuators, a third said movable member engaging at each longitudinal end thereof said second movable member and a fourth said moveable member, said fourth movable member engaging at each longitudinal end thereof the other of said pair of lifting-pressure actuators and said gripping pressure regulator.

31. A load-handling device according to claim 23, wherein said gripper comprises clamps.

32. A load handling device according claim 23, wherein said gripper is mounted to a mast for movement along a length defined by said mast, said tilting actuator acting on said mast.

33. A control apparatus for a load-handling device including a gripper for handling a load being connected to pressure controlled gripping, lifting and tilting actuators for respectively gripping, lifting and tilting the handled load; said control apparatus comprising a pressure-sensing actuator assembly for being placed in pressure communication with the lifting and tilting actuators and adapted to be actuated by the pressure exerted on the lifting and tilting actuators;

a gripping pressure regulator for regulating the gripping pressure exerted on the gripping actuator; and a pressure control assembly comprising four interrelated pivotable members for interacting with said pressure-sensing actuator assembly during actuation thereof and for acting on said gripping pressure regulator;

wherein said pressure-sensing actuator is adapted to sense the weight of the load from the pressure exerted on the lifting and tilting actuators and to be accordingly actuated by this pressure thereby so interacting with said pressure control assembly as to provide for said pressure control assembly to consequently act on said gripping pressure regulator in order to provide a suitable gripping pressure in response to the weight of the load.

34. A control apparatus for a load-handling device including a gripper for handling a load being connected to pressure controlled gripping, lifting and tilting actuators for respectively gripping, lifting and tilting the handled load; said control apparatus comprising a pressure-sensing actuator assembly for being placed in pressure communication with the lifting and tilting actuators and adapted to be actuated by the pressure exerted on the lifting and tilting actuators;

a gripping pressure regulator for regulating the gripping pressure exerted on the gripping actuator;

a pressure control assembly comprising interrelated movable members for interacting with said pressure-sensing actuator assembly during actuation thereof and for acting on said gripping pressure regulator; and a housing for housing said pressure-sensing actuator assembly, said gripping pressure regulator, and said pressure control assembly, said housing comprising:

a base for housing said pressure sensing actuator assembly and said gripping pressure regulator and a cover for housing said pressure control assembly, said cover being mounted to said base thereby providing said pressure control assembly to interface with said pressure sensing actuator assembly and said gripping pressure regulator; and hydraulic pipes for communicating with said pressure sensing actuator assembly and said gripping pressure regulator said hydraulic pipes being placed in hydraulic communication with the gripping, lifting and tilting actuators via hydraulic pressure lines, wherein said pressure-sensing actuator is adapted to sense the weight of the load from the pressure exerted on the lifting and tilting actuators and to be accordingly actuated by this pressure thereby so interacting with said pressure control assembly as to provide for said pressure control assembly to consequently act on said gripping pressure regulator in order to provide a suitable gripping pressure in response to the weight of the load.

* * * * *